US005671583A

United States Patent [19]

Turner

[11] Patent Number: 5,671,583

[45] Date of Patent: Sep. 30, 1997

[54] CONSTRUCTION MEMBER AND METHOD FOR FORMING ARCHWAYS AND THE LIKE

[76] Inventor: Arthur Ray Turner, 9 The Parapet, Terranora N.S.W. 2486, Australia

[21] Appl. No.: 818,165

[22] Filed: Jan. 8, 1992

Related U.S. Application Data

[63] Continuation-in-part of Ser. No. 763,424, Sep. 20, 1991, which is a continuation of Ser. No. 489,484, Mar. 6, 1990.

[51] Int. Cl.[6] ..... E04G 15/02

[52] U.S. Cl. ..... 52/745.16; 52/85; 52/88; 52/745.15

[58] Field of Search ..... 52/417, 85, 86, 52/87, 88, 89, 746, 745.16, 745.15, 745.05

[56] References Cited

U.S. PATENT DOCUMENTS

| | | | |
|---|---|---|---|
| 1,988,739 | 1/1935 | Jones | 52/85 |
| 2,064,704 | 12/1936 | Vass | 52/85 |
| 2,442,929 | 6/1948 | Marino | 52/85 |
| 3,008,273 | 11/1961 | Widin | 52/85 |
| 3,159,251 | 12/1964 | Becker . | |
| 3,847,006 | 11/1974 | Rose | 52/85 |

OTHER PUBLICATIONS

National Gypsum Company; Gypsum Construction Guide '92 Edition; p. 40.

*Primary Examiner*—Christopher Todd Kent
*Attorney, Agent, or Firm*—Blakely Sokoloff Taylor & Zafman

[57] ABSTRACT

Construction members and methods of forming archways and the like in wood or metal frame construction is disclosed. The member is of an elongate planform having a central body of the width of the archway to be formed, with a plurality of tabs at each side thereof which may be bent at right angles to the body and, once the member is curved as desired, nailed or screwed to the structure to define the desired shape prior to finishing the same. In an alternate form, the body is wider than the archway to be formed, with the tabs spaced inward from the edges thereof so as to be spaced in accordance with the archway width. The outer extending edges thereby provided in the archway, once installed, provide a finishing edge for the wallboard finishing the structure. Various embodiments and materials including metal and plastic for the invention are disclosed.

6 Claims, 17 Drawing Sheets

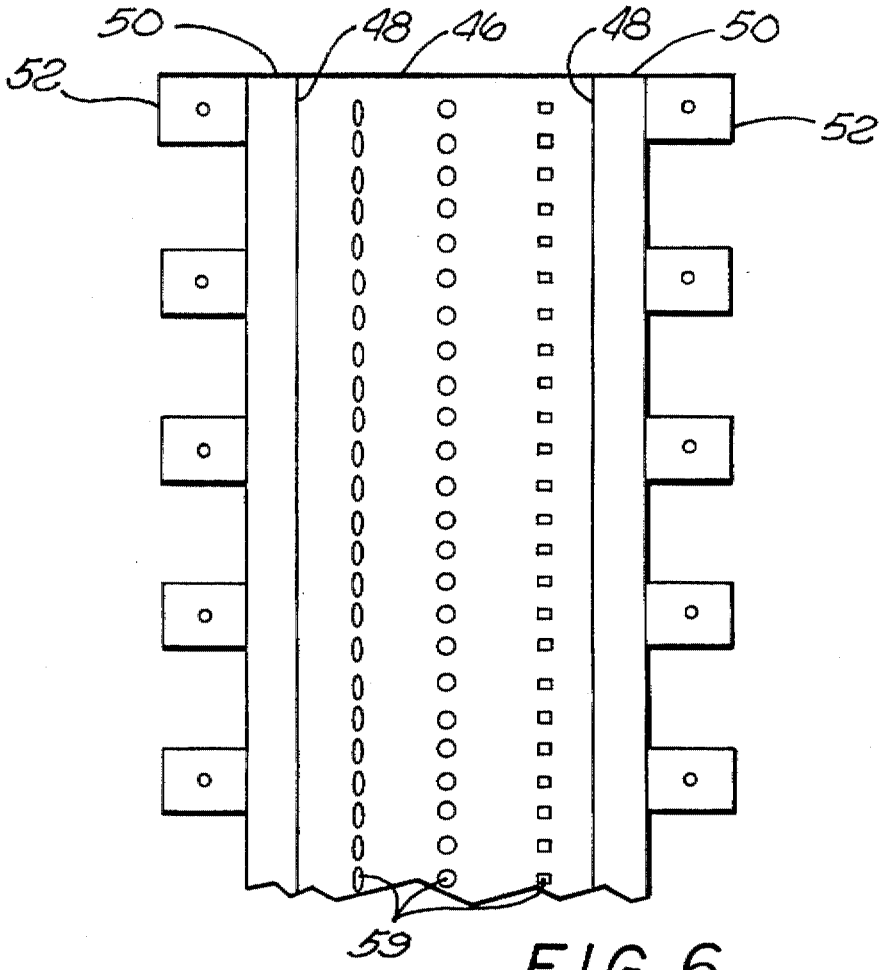
FIG. 6
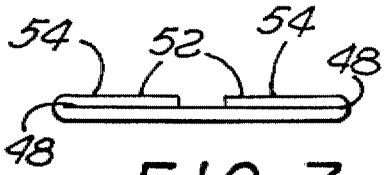
FIG. 7
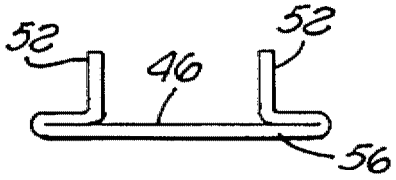
FIG. 8
FIG. 9
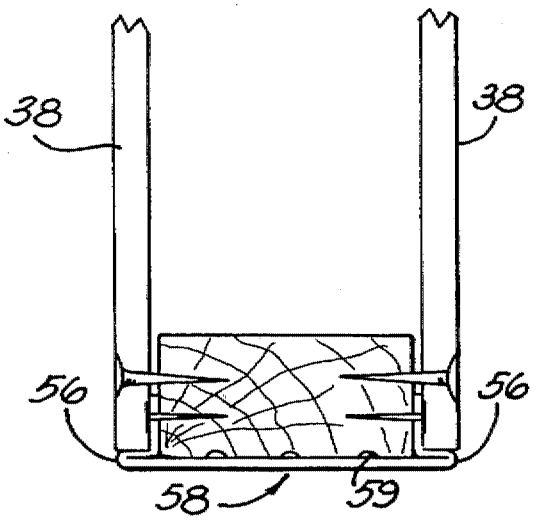

FIG. 22
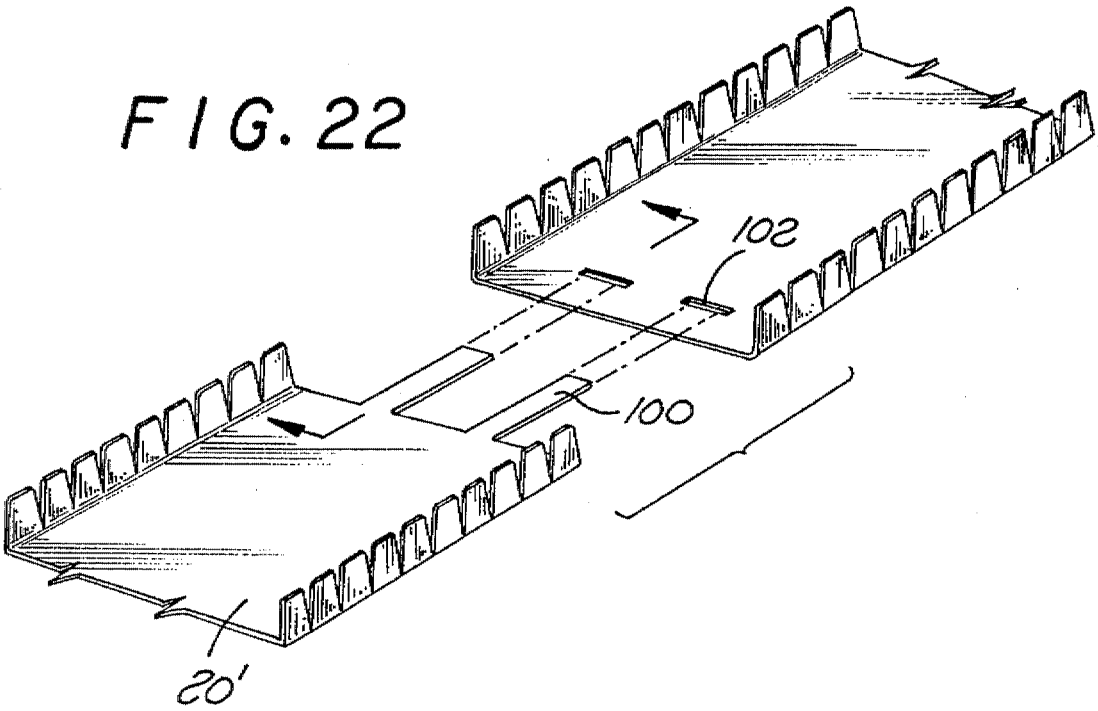
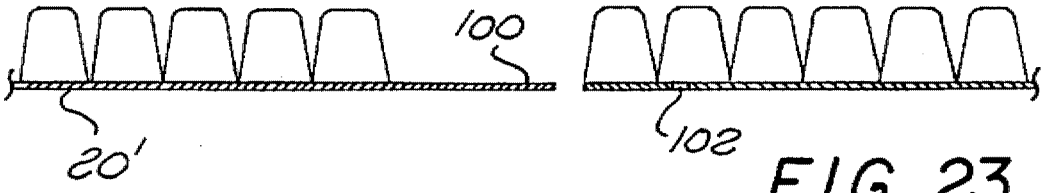
FIG. 23
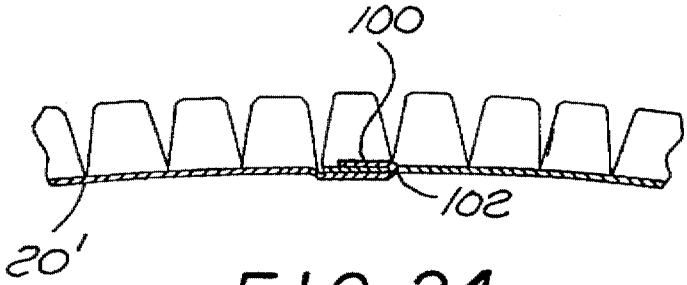
FIG. 24

FIG. 28a
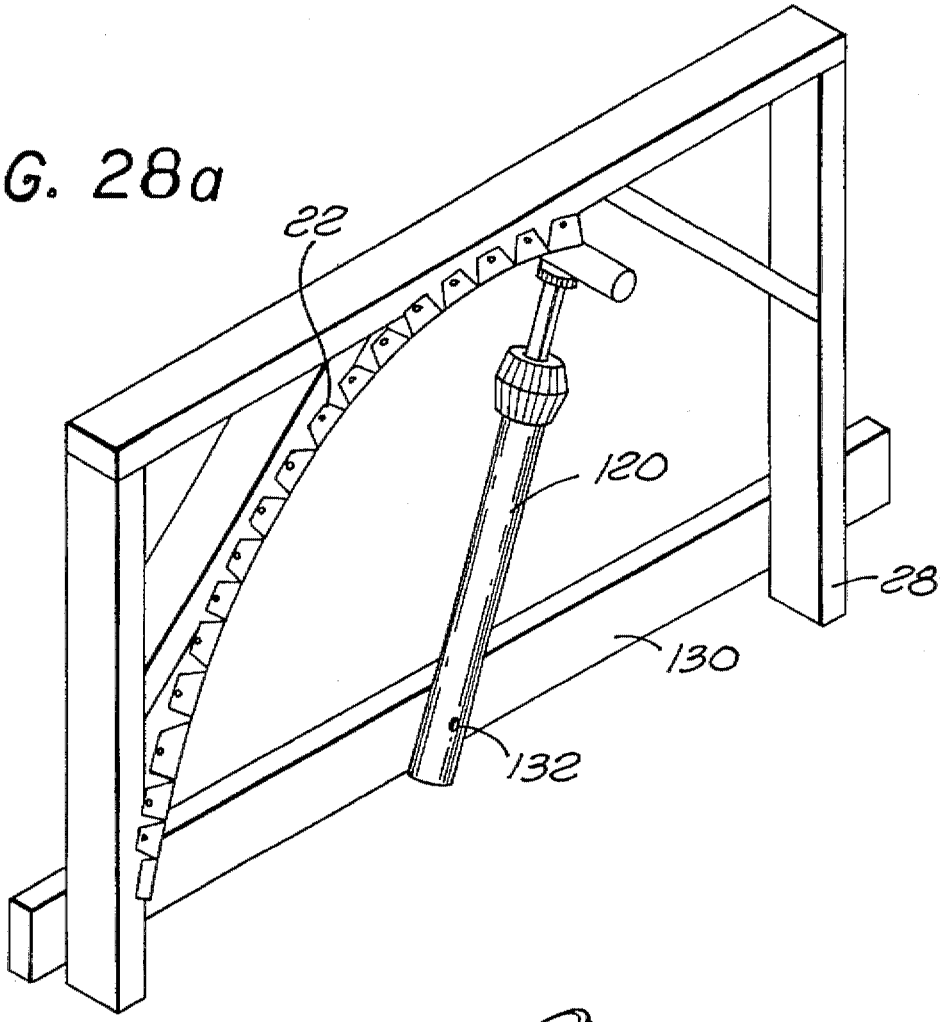
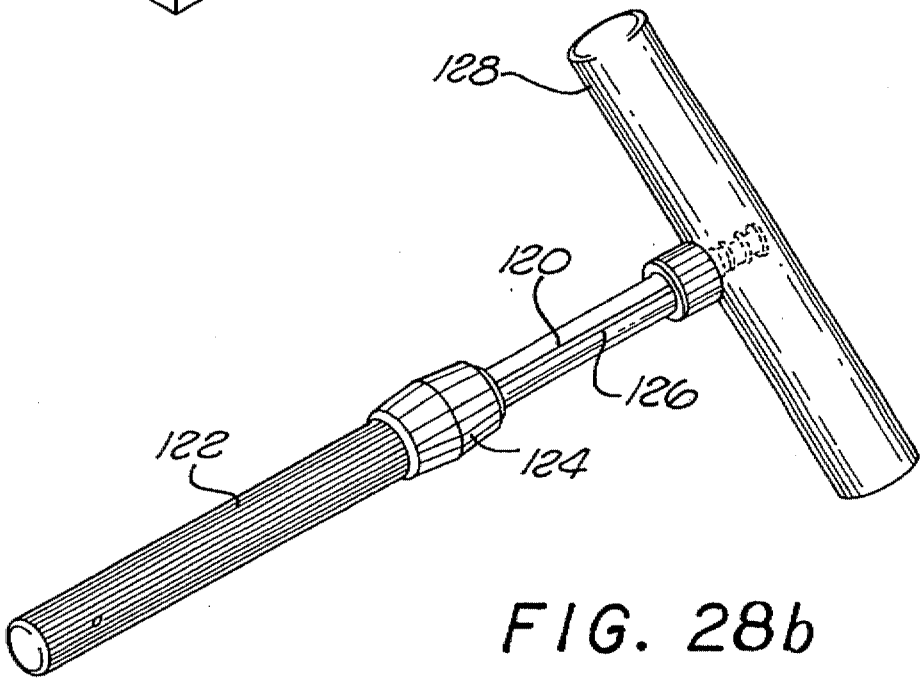
FIG. 28b

FIG. 31
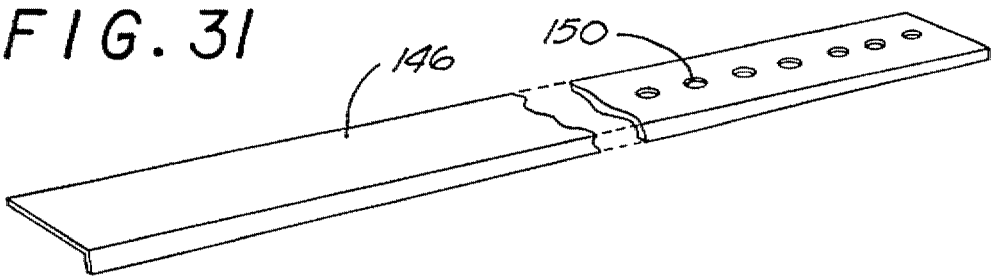
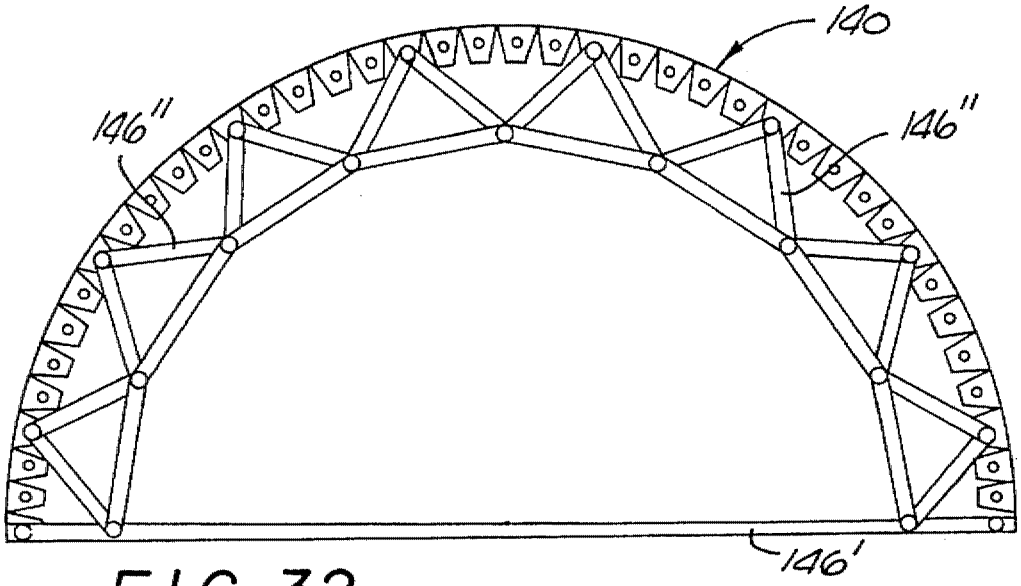
FIG. 32
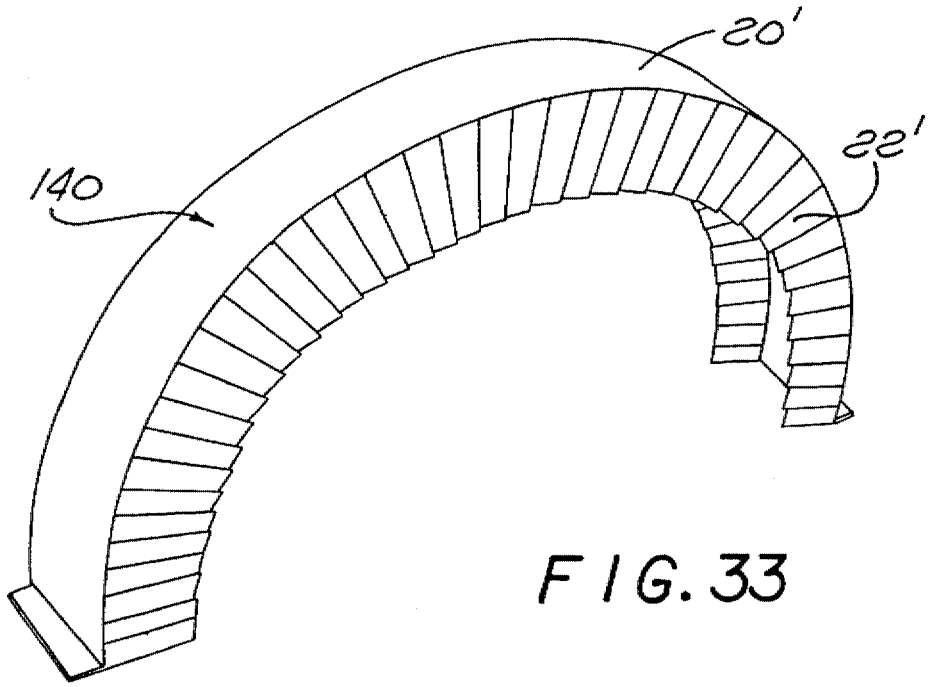
FIG. 33

FIG. 34
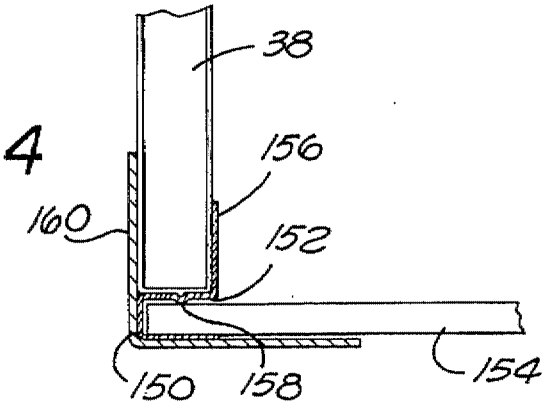
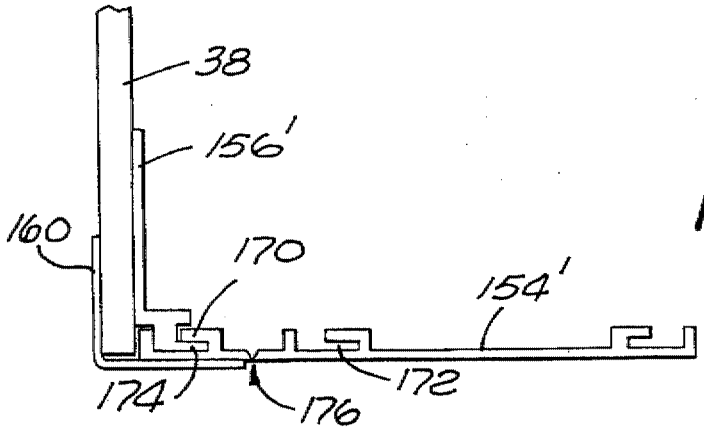
FIG. 35
FIG. 36
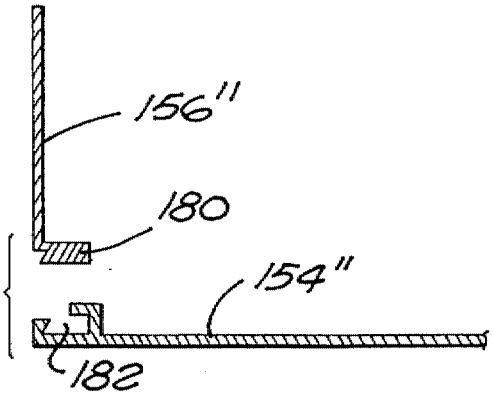
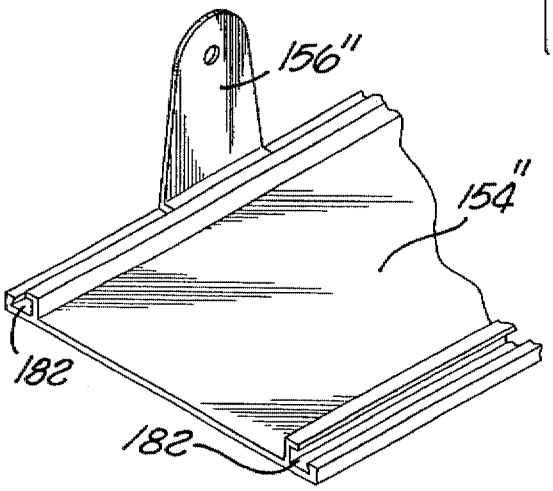
FIG. 37

CONSTRUCTION MEMBER AND METHOD FOR FORMING ARCHWAYS AND THE LIKE

This application is a continuation-in-part of application Ser. No. 763,424 filed on Sep. 20, 1991, which is a continuation of application Ser. No. 489,484 filed on Mar. 6, 1990.

BACKGROUND OF THE INVENTION

1. Field of the Invention

The present invention relates to the field of wood frame and metal frame construction.

2. Prior Art

The archways above windows, passageways, interior and exterior doors, openings and nooks are usually formed on-site by the builder in plywood using multiple blocking as a back-up and to form the archway. In general, such arched openings can vary from a true radius half-circle to low-rise, elliptical arches to eye-brow constant radius arches and quarter circle true radius arches. In addition, walls themselves can vary in thickness from a nominal 4 to 6 inches to 8, 10 and 12 inches in thickness. The construction of such archways on-site using such prior art methods is time-consuming, and of course expensive because of the high on-site labor rates.

To simplify the fabrication of archways, Stretch Forming Corporation manufactures and sells a product which they refer to as the Easy Arch. From the product literature, it appears that the product is stretch-formed from a U-shaped channel section into the desired curved shape, the rather short legs of the U compared to the base thereon forming a flange around the outer portion of the arch for nailing to the trimmer and header defining the basic rectangular opening for the arch. When so used, the Easy Arch may be easily and quickly installed and accurately defines the arch curvature, and to that extent functions very well for the intended purpose. It has certain disadvantages, however, relating generally to its prefabrication into the intended shape. In particular, because it is manufactured in the desired shape and then shipped, stocked, etc., the product is bulky and thus not easily shipped or stored, and of course is easily subject to damage. Also, because the shape as well as the width is defined at the time of manufacture, many different sizes must be made available to accommodate various builders' needs. By way of example, product literature on the Easy Arch shows 34 different arch sizes and/or forms available for 4" walls alone, with a substantial number also being available for 6" walls. Accordingly, the product is not readily stocked, and presents substantial problems with respect to availability and shipping to the construction site. Similarly, the product, at least at present, is not available for use with thicker walls or for widths in-between the preformed sizes. Also, the Easy Arches are made to replace plywood arches, which means that the rock wall sheeting is applied over these arches and fixed to them with self-tapping speed screws. Consequently, there needs to be a further preformed metal corner over the rock wall sheeting to finish off the edge of the rock wall sheeting around these openings.

BRIEF SUMMARY OF INVENTION

Construction members and methods of forming archways and the like in wood or metal frame construction are disclosed. The members are of an elongate planform having a central body of the width of the archway to be formed, with a plurality of tabs at each side thereof which may be bent at right angles to the body and, once the member is curved as desired, nailed or screwed to the structure to define the desired shape prior to finishing the same. In an alternate form, the body is wider than the archway to be formed, with the tabs spaced inward from the edges thereof so as to be spaced in accordance with the archway width. The outer extending edges thereby provided in the archway, once installed, provide a finishing edge for the wallboard finishing the structure. Various embodiments and materials including metal and plastic for the invention are disclosed.

An alternate embodiment is disclosed which can be used as a form for constructing archways of an external wall, wherein the masonry is built up around the form.

BRIEF DESCRIPTION OF THE DRAWINGS

FIG. 6 is a planform view of an alternate embodiment metal arch member in accordance with the present invention.

FIG. 7 is a cross sectional view of the arch member of FIG. 6 illustrating the same after the side regions thereof have been bent through an angle of approximately 180° to lie against the center section of the arch member.

FIG. 8 is a cross section similar to FIG. 7 after the tabs 52 have been bent outward.

FIG. 9 is a cross section through the top of a wood frame construction archway utilizing the arch member embodiment FIGS. 6 through 8.

FIG. 22 shows an elongated member having flanges adapted to be inserted into apertures on the other end of the member.

FIG. 23 is a cross section of FIG. 22 showing the ends of the elongated member.

FIG. 24 is a cross section of the elongated member of FIG. 22 showing the flange of one end of a member attached through an aperture on the other end of an elongated member.

FIG. 28*a* is a perspective view showing an arch member being installed in an opening by a tool.

FIG. 28*b* is a perspective view of the tool of FIG. 28*a*.

FIG. 31 is a perspective view of a spoke used to support a form.

FIG. 32 is an alternate embodiment of the form of FIG. 30.

FIG. 33 is an alternate embodiment of the form of FIG. 29.

FIG. 34 is a cross section of an assembled arch member showing one half attached to an archway.

FIG. 35 is a cross section of an alternate snap together arch member attached to an external window.

FIG. 36 is a cross section of an alternate embodiment of a two piece arch member similar to FIG. 35.

FIG. 37 is a perspective view of the arch member of FIG. 36;

DETAILED DESCRIPTION OF THE INVENTION

Figure 1:
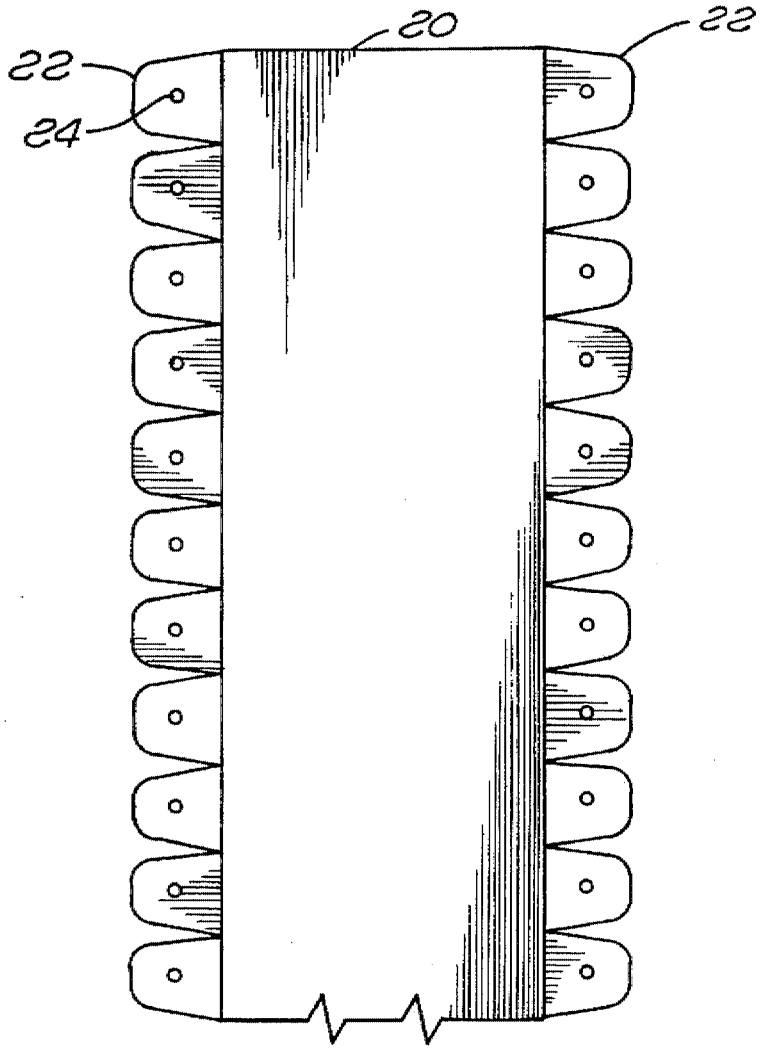
FIG. 1 is a planform view of one embodiment of metal arch member in accordance with the present invention.

One of the objects of the present invention is to make flat metal arches that can be bent to any arch configuration by the builder on-site, and to fit any width of opening as desired. While various embodiments of the invention are disclosed herein, a preferred embodiment is disclosed in FIG. 1 which shows the planform of an arch member in accordance with the present invention. As shown therein, the arch member is comprised of an elongate body section 20 with a plurality of tabs 22 integral therewith and equally spaced along the opposite edges of the elongate body section 20. In this embodiment the tabs 22 are perforated with pre-formed holes 24 for receiving nails or self-tapping speed screws for holding the member in position. Typically the arch member as illustrated in FIG. 1 is fabricated from galvanized steel, such as, by way of example, 26, 24 or 22 gauge steel.

In the specific embodiment illustrated, intended for use for 4" walls, the body member 20 is 3½" wide and 8 feet long (though obviously other lengths, even larger lengths may be provided as the product is easily cut to a desired shorter length on the construction site, or the same can be supplied in roll form using a dispensing cartoon), with the tabs extending outward therefrom 1" at each side. Obviously, of course, these dimensions may be varied as desired. By way of example, the width of the body section 20 may readily be varied to accommodate various wall thicknesses. Similarly, the number, proportions and spacing of the tabs along each side may be varied as desired. In that regard, preferably the tabs are kept relatively narrow so that any tab does not extend over any significant length of the body section 20, as the tabs, when bent 90° with respect to the body section, tend to rigidify the body section and not allow the substantial bending or curving thereof in the region of the tab. On the other hand, the tabs may be altered in shape and number as desired, up to and including tabs which are essentially touching each other, the product in that form essentially comprising an elongate member having a plurality of slits along each side thereof.

Figure 2:
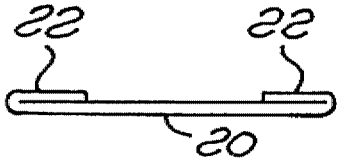
FIG. 2 is a cross sectional view of FIG. 1 after the tabs 22 thereof have been bent through an angle of approximately 180° to lie against the center section 20.
Figure 3:
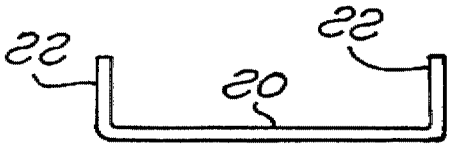
FIG. 3 is a cross section similar to the cross section of FIG. 2 illustrating the tabs 22 after the same have been bent to approximately a 90° angle with respect to center section 20.

At the time of manufacture the tabs 22 may be folded over approximately 180° to lie against the body section 20, as may be seen in FIG. 2. This folding can be done accurately in a manufacturing environment to accurately define the desired width of the arch member along its entire length. Once bent as shown in FIG. 2, the tabs will generally bend upward 90° from the position shown (see FIG. 3) generally at the same location or perhaps very slightly further outward on the tab, in neither event affecting the planarity of the body section 20 or the width thereof. The folding of course makes the product narrower for packaging the shipment, typically in bundles, and protects the tabs from being bent and distorted during shipment and handling. Preferably however, the tabs are bent to the 90° position shown in FIG. 3 at the time of manufacture. When so bent, the body section 20 will remain relatively flexible and may easily be bent along its length into the desired shape of the archway. In that regard, the bending in an arch normally preferable is within the elastic range of the material so that the same assumes a smooth curve or curves as desired (which could include one or more straight segments) without any sharp discontinuities, though of course one or more distinct bends through material yielding may also be included if desired. (Note also that positive and negative curvature bends, may be made, as may also be desirable for soffits and the like.)

Figure 4:
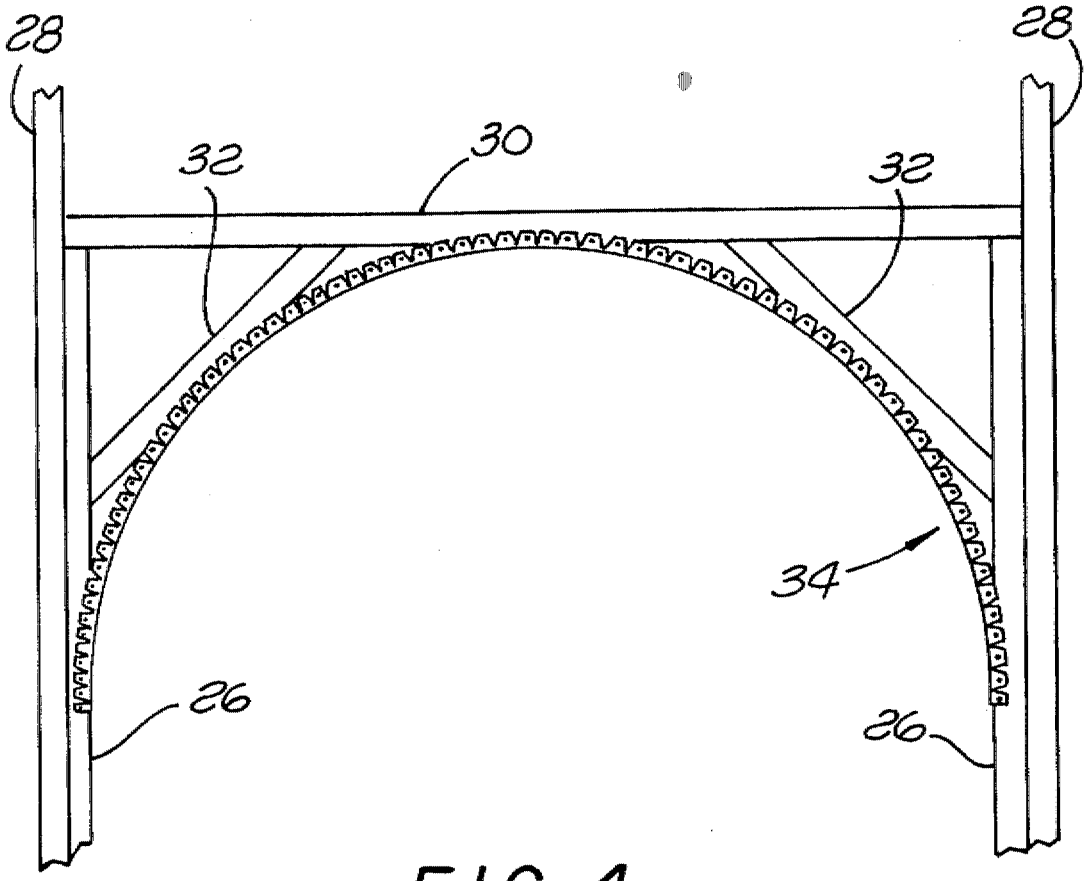
FIG. 4 is a face view of wood frame or metal frame construction illustrating the definition of an archway opening through the use of an arch member of FIGS. 1 through 3.
Figure 5:
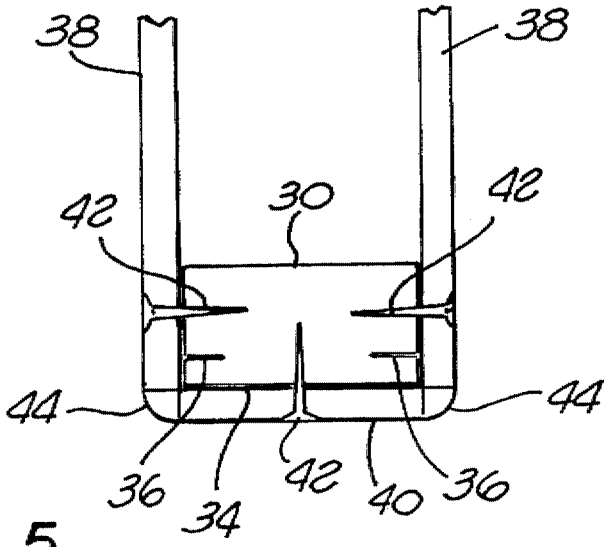
FIG. 5 is a cross section taken through the top of a completed archway such as that of FIG. 4.

As illustrated in FIG. 4, in woodframe construction the opening within which the arch is to be formed is defined by a pair of trimmers 26 nailed to king studs 28 and at the top by a header 30. Also, one or more corner braces 32 are nailed to the header 30 and the trimmers 26 to roughly define the desired arch opening. Thereafter, the arch member, generally indicated by numeral 34, is placed in position and nailed through the appropriate tabs to the trimmers, the header, and the corner braces. Drywall mud may then be applied directly to the arch member to finish the arch. FIG. 5 shows an alternate embodiment, wherein the arch member 34 is nailed to the header 30 by nails 36, and a strip of wallboard 40 is bent and fastened to the inner surface of the arch member 34 with speed screws 42. The assembly is then finished off with corner beads 44.

In the case of metal frame construction, FIGS. 4 and 5 are in essence directly applicable, metal frame construction generally using sheet metal members bent into a channel form and assembled throughout with self tapping speed screws, rather than the 2×4s, nails, etc. of wood frame construction.

Now referring to FIGS. 6 and 7, an alternate embodiment of the present invention somewhat similar to that of FIGS. 1 and 2 may be seen. While this embodiment may be dimensionally configured for walls of various thicknesses, for purposes of specificity, typical dimensions will be given for 4" walls (3½" wide for the wide dimensions of the 2×4s of wood frame construction). Here the center part of the body section 46 between lines 48 has a width of 4¾", with the portions 50 of the body section each having a width of ⅝ of an inch, the tabs 52 being rectangular in form, spread apart and pre-pierced, etc., though the tabs of the embodiment of FIG. 1 may be used if desired. During manufacture, the body section is folded along lines 48, as may be seen in FIG. 7, and preferably the tabs are bent upward 90° at the same time, as shown in FIG. 8, though if desired in this embodiment, optional roll-formed depressions 54 may be formed separating the tabs from the adjacent regions 50 of the body section to define lines of least resistance to bending when the tabs 52 are bent upward at right angles at the time of installation. With the proportions hereinbefore described, the tabs 52 when so bent upward now have a spacing of 3½" as appropriate for a 4" wall thickness, with beaded edges 56 extending outward beyond the upward extending tabs 52 by ⅝", the thickness of typical wallboard. In installation, the embodiment of FIGS. 6 through 8 as viewed from the side will appear substantially identical to FIG. 4 illustrating the embodiment of FIG. 1. The cross section equivalent to that of FIG. 5, however, is significantly different, as shown in FIG. 9. As can be seen therefrom, the beaded edges 56 provide reinforced corners for the arch opening, with any gap between the wall board 38 and the arch member, generally indicated by the numeral 58, and particularly the beaded edges 56 thereon, being easily plastered over. Also, as may be seen in FIG. 9, the lower surface of the arch member itself defines the arch opening without any additional wallboard strip being fastened thereto.

Plaster can then be applied directly to the arch member. To facilitate adhesion of the plaster to the member, the elongate body section 20 may have a plurality of perforations 59 or dimples along the length of the arch member as shown in FIG. 6. The perforations 59 create voids for the plaster to fill, to provide better attachment of the plaster. FIG. 6 shows circular, square and oblong shaped perforations 59, it being understood that a variety of perforated shapes and arrangements can be used. Preferably these perforations are kept small to avoid slumping of the plaster, and may be numerous for best adhesion. It has been found that plaster will tend to bubble and peel away from metal stripping. In the preferred embodiment, the metal arch members are treated with a bonding agent that prevents any chemical reaction between the zinc in the metal and the alkali of the plaster.

Figure 10:
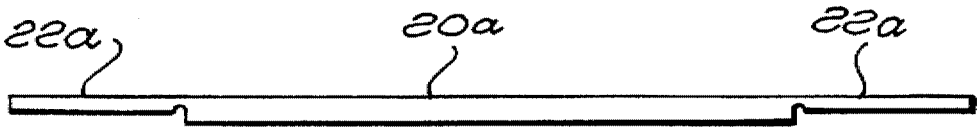
FIG. 10 is a cross sectional view of an embodiment similar to that of FIG. 1 though fabricated in plastic.
Figure 11:
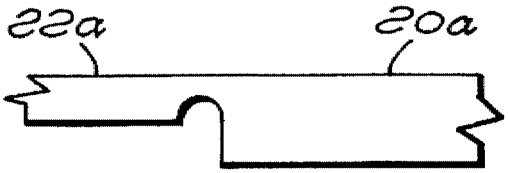
FIG. 11 is a view of a portion of a cross section of FIG. 10 taken on an expanded scale.
Figure 12:
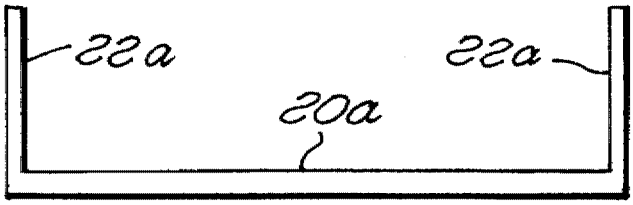
FIG. 12 is a cross section illustrating the tabs of the embodiment of FIGS. 10 and 11 in the 90° position.

The general concepts of the present invention hereinbefore described with respect to embodiments fabricated from sheet metal are also applicable to arch members fabricated of other materials, preferably plastics which are not brittle, but rather which will yield when thin sections thereof are bent without cracking or separating, so that the plastic arch members may be fabricated flat or to the completed shape as FIG. 8, with the tabs being bent upon installation or more preferably at the time of manufacture as with the metal arch members. Thus in the plastic equivalent to the arch member illustrated in FIGS. 1 through 5, such a plastic arch member may have the same planform as illustrated in FIG. 1. In cross section however, it is preferred to use a thicker section for the body 20 than for the tabs 22. Thus, as shown in FIG. 10, body section **20*a* for the plastic arch member is shown substantially thicker than the tabs 22*a*. If the 90° bends are to be formed at the time of installation, the region coupling the tab to the body section may be made even thinner, as better illustrated in the expanded section of FIG. 11, to define a hinge region therebetween for bending upon installation. Such a configuration may readily be fabricated by hot rolling an appropriate plastic to thin the desired portions thereof, with the tabs being cut and perforated etc., thereafter. Preferably however, the member is formed to the final shape shown in FIG. 12 at the time of manufacture. Although a plastic arch with a thicker base portion is described and shown in FIGS. 10 and 12**, it is to be understood that the plastic arch member may have a uniform thickness throughout.

Figure 13:
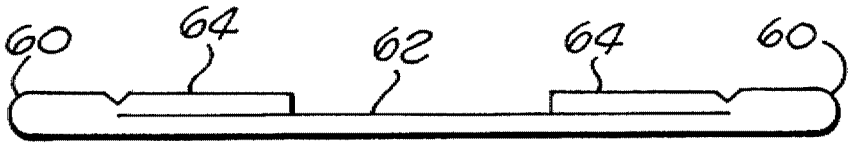
FIG. 13 is a cross section of an alternate embodiment of a plastic arch member similar to the metal arch member of FIGS. 6 through 9.
Figure 14:
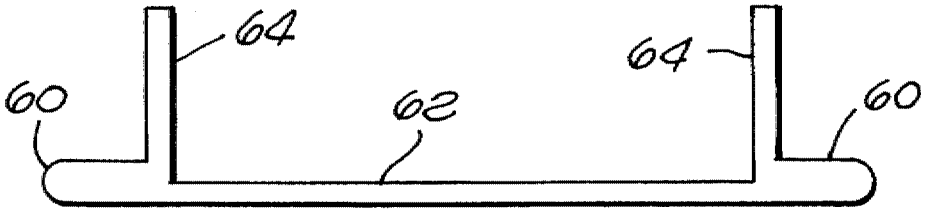
FIG. 14 is a cross section illustrating the tabs of the embodiment of FIG. 13 in the 90° position.

FIG. 13, on the other hand, presents a cross-section of an embodiment similar to that of FIGS. 6 through 9, though again fabricated from plastic. In this embodiment, it is preferred to have the edge regions 60 thicker than the center section 62 and the tab 64. For this purpose, a strip of plastic or appropriate thickness may be folded to provide a double thickness at the edges, or alternatively, this strip may be hot rolled to define regions of different thicknesses, so that when folded, the edges, tabs, and center section have the desired thickness relationships. Upon installation of course, these plastic embodiments appear substantially the same as is illustrated in FIGS. 4, 5 and 9. Again, preferably the tabs are bent to the 90° angle at the time of manufacture, as shown in FIG. 14.

In the embodiments hereinbefore described, the tabs have been described as being bent at 90° or folded inward at the time of manufacture as illustrated in FIGS. 2, 3, 7, 8, 12, 13 and 14. Obviously, of course the tabs could be left outstretched at the time of manufacture, such as by way of example is illustrated in FIG. 1, to be bent therefrom to a 90° angle at the time of installation. Further of course, while the embodiment of FIG. 7 has been disclosed and described herein as possibly having roll formed predefined lines 54 at least resistance to bending so that the tabs may be easily and accurately bent to the 90° angle at the time of manufacture, other embodiments such as the embodiment of FIGS. 1 and 10 may also incorporate such a feature. Also, as previously stated, preferably the tabs in any of the embodiments disclosed herein, whether of metal or plastic, are bent to their final 90° angle at the time of manufacture. While such a product is a bit more difficult to handle, ship, store, etc., the same reduces the amount of on-site labor required to install the same. Also, such a product is still as easy or easier to package and ship than the Easy Arch, as the same could be easily supported during shipment, storage, etc. by placing the same over a 2×4 for support until such time as it is to be used. Such a preformed member, of course, will still have the advantage of allowing one arch member to form any arch shape of a given wall thickness. Such configurations will locate the tabs at the 90° angle with typical manufacturing accuracies, as opposed to the less accurate on-site bending of the tabs, and of course eliminate any tendency of the tabs to tend to return toward the unbent condition making placement of the same over the 2×4 forming the opening of the archway more difficult. The forming of the tabs at the 90° angle at the time of manufacture in the case of a plastic product would also allow the use of plastics which are sufficiently strong, to which paint or drywall mud will adhere well, etc., but which may tend to crack or separate if any significant thickness thereof is bent through a sharp 90° angle while cold.

Figure 15:
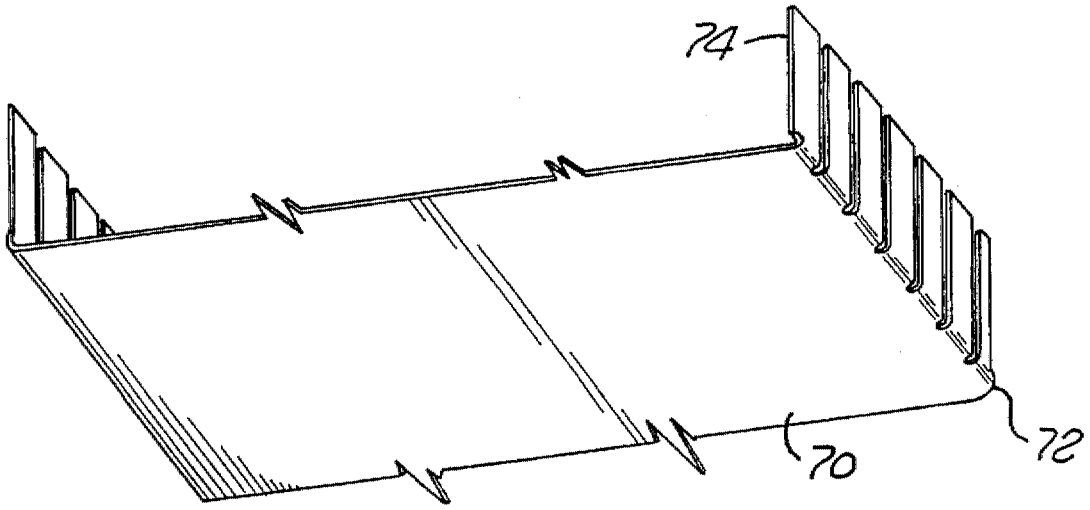
FIG. 15 is a view of a section of a square-edged finishing member.
Figure 16:
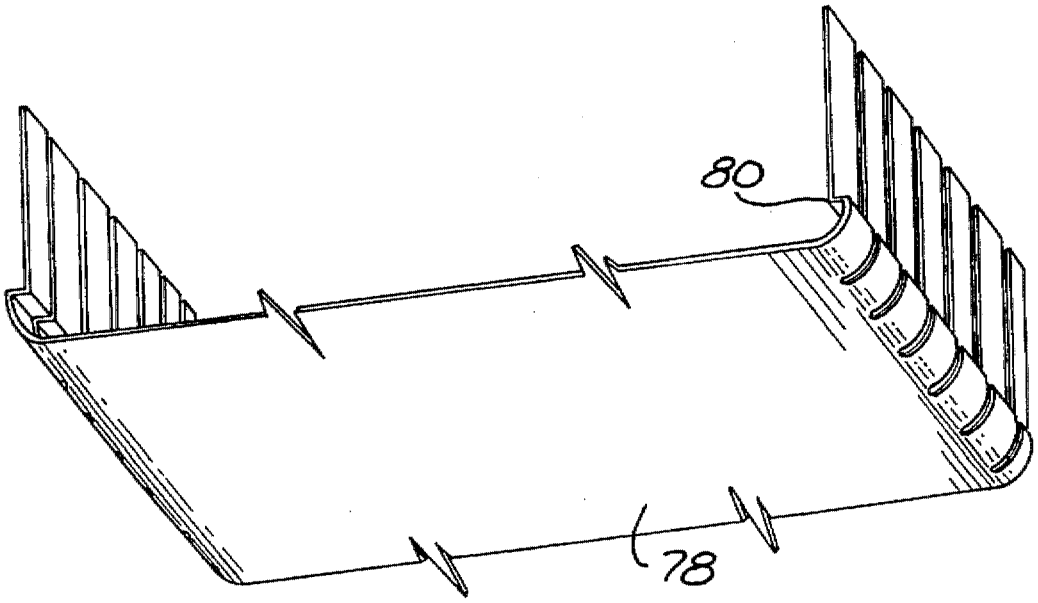
FIG. 16 is a view of a section of a round-edged finishing member.
Figure 17:
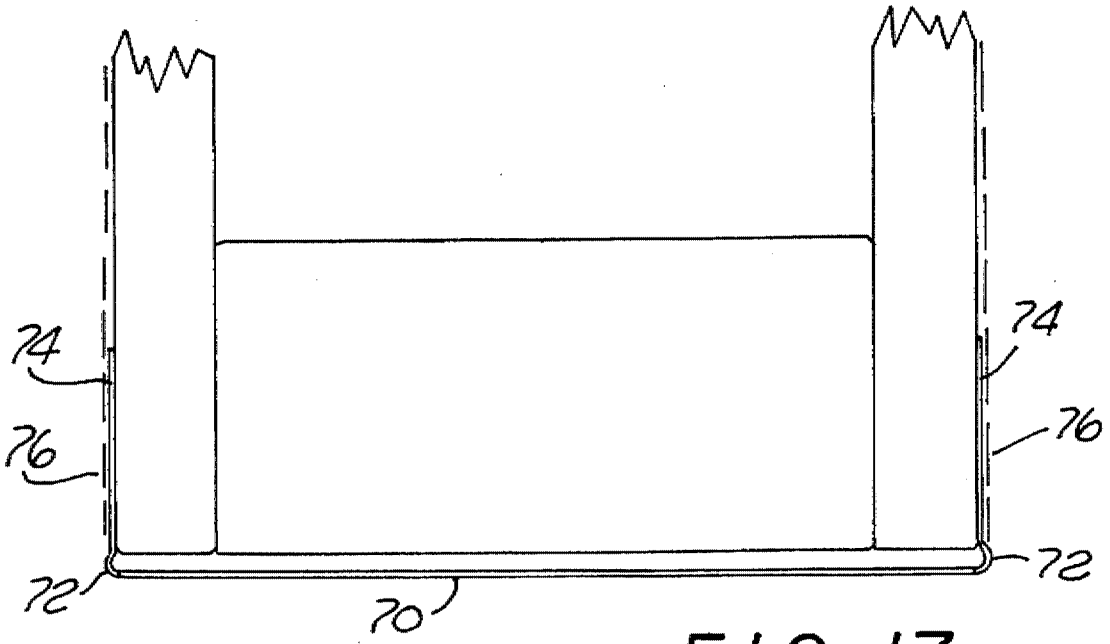
FIG. 17 is a cross section illustrating the use of the finishing member of FIG. 15 for door or window archways and jams.

Referring to FIGS. 15 and 16, sections of flexible finishing archway members may be seen. Member 70, shown in FIG. 15, is provided with a small, bead-like edge 72 at each edge thereof with tabs 74 extending outward therefrom at a 90° angle with respect to the body of member 70 and with the spacing corresponding to the archway thickness including the wall board on each side thereof. The installation of member 70 may be seen in FIG. 17, wherein the member is nailed in position through the tabs as a finishing member for the archway, the tabs being skim plastered in region 76 to the beads 72 to cover the individual tabs, nails, etc.

Figure 18:
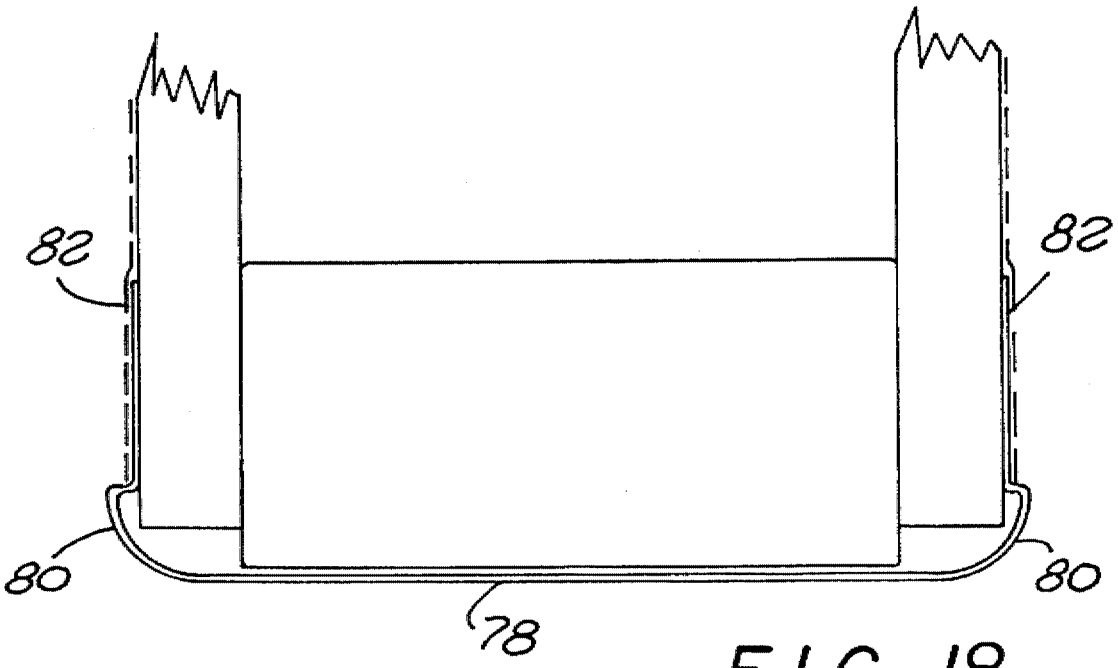
FIG. 18 is a cross section illustrating the use of the finishing member of FIG. 16 for door or window archways and jams.

The member 78 shown in FIG. 16 is similar to that of FIG. 15, being rounded at the corners 80, however, to provide a rounded edge archway upon installation, as is illustrated in FIG. 18, with region 82 again being skim plastered for finishing purposes.

While the flexible member 70 and 78 shown in FIGS. 15 and 16 have been disclosed and described as being used as finishing members for archways, it should be understood that such members may also be used for straight door or window jams, and of course as before may be fabricated of steel or plastic as desired. To enhance paint adhesion, the members may be covered with a laminated paper tape on the exposed surfaces, particularly useful in the case of steel as adhesion of normal house paints to steel surfaces is generally less than desired. Steel arch members can be constructed without a wax coating on the steel surface or stamped without a lubricant such that the paint or plaster will more readily adhere to the surface of the member. Of course, as with the flexible arch members of FIGS. 1 through 14, members 70 and 78 may be fabricated in relatively long lengths such as, by way of example, 20 foot lengths and cut as desired at the time of installation.

Figure 19:
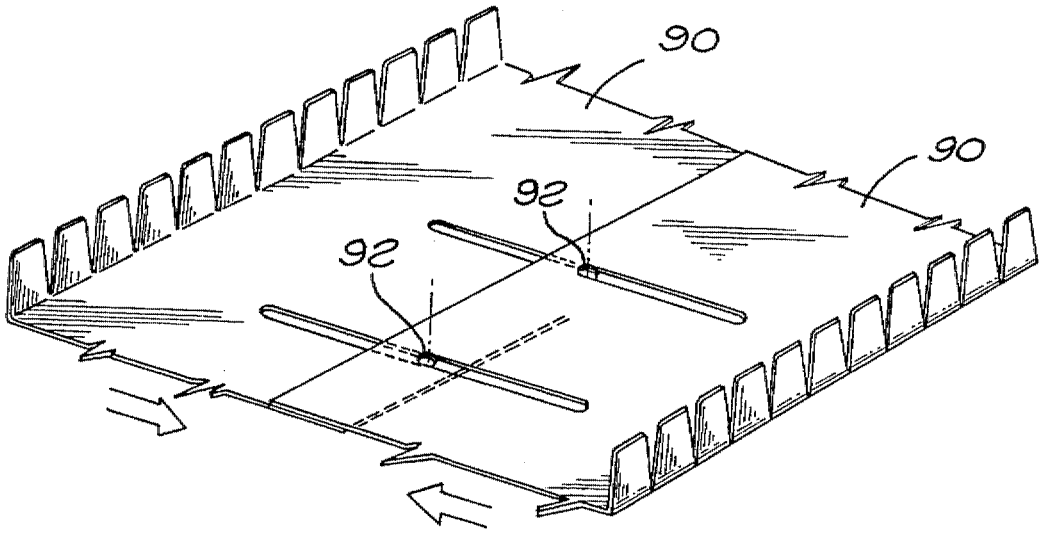
FIG. 19 is a view of a two piece arch member at the maximum limit of its adjustability.
Figure 20:
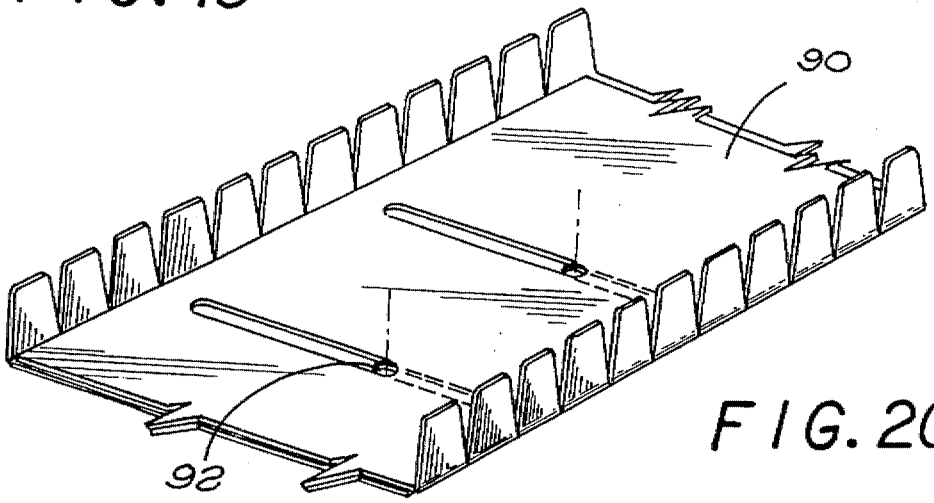
FIG. 20 is a view of a two piece arch member at the minimum limits of its adjustability.

In the description of the flexible arch members of FIGS. 1 though 14, all such arch members have been disclosed and described herein as being single piece members. It should be understood however that the invention illustrated in those figures may be fabricated in two pieces and joined at the time of installation to provide the desired width. Such an embodiment is illustrated in FIGS. 19 and 20. As is illustrated in FIG. 19, the flexible arch member is actually comprised of two L-shaped arch member portions, each of which is slotted periodically along its length so that the two portions may be bolted together by bolts 92. The left and right members 90 may be identical members, thereby simplifying manufacturing. The advantage of such a system obviously is that the width thereof is readily adjustable, FIGS. 19 and 20 illustrating the two extremes for the adjustable width of the structure shown. Such a configuration still further reduces the number of flexible arch members which must be manufactured to accommodate variations in wall thickness.

Figure 20A:
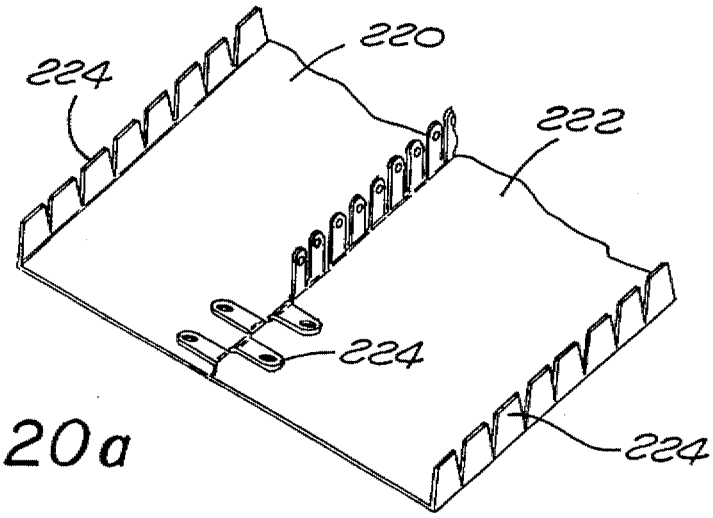
FIG. 20*a* is a perspective view of a pair of elongated members attached to create a wider arch member.

FIG. 20*a* shows two members 220 and 222 adjoined to create a wide arch member. The members 220 and 222 may be connected by screwing together the adjacent tabs 224 and then bending the tabs 224 as shown. Although two members are shown, it is to be understood that any number of members can be joined together, so that the user may construct archways wider than the standard stock members that will typically be sold.

Figure 21A:
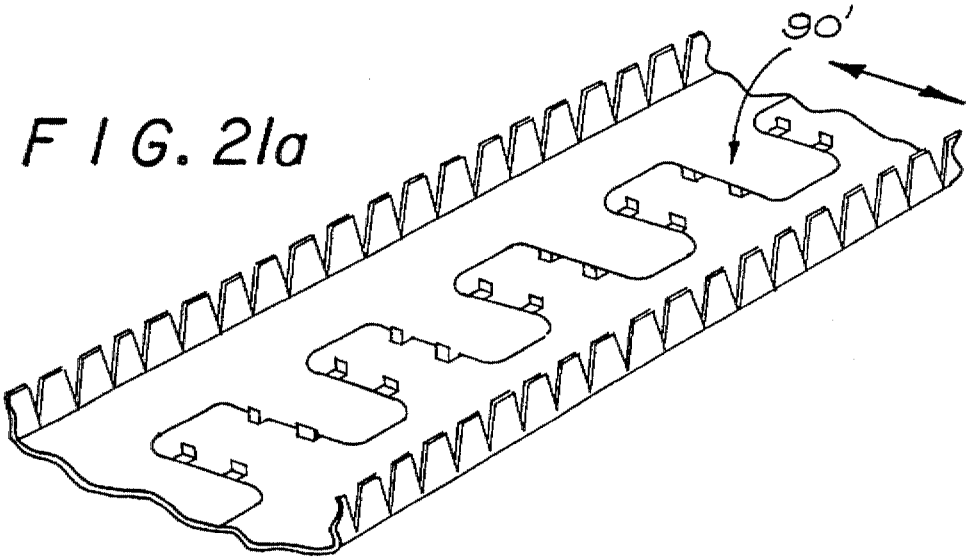
FIG. 21*a* is a view of an alternate two piece arch member having fingers that are attached by tabs.
Figure 21B:
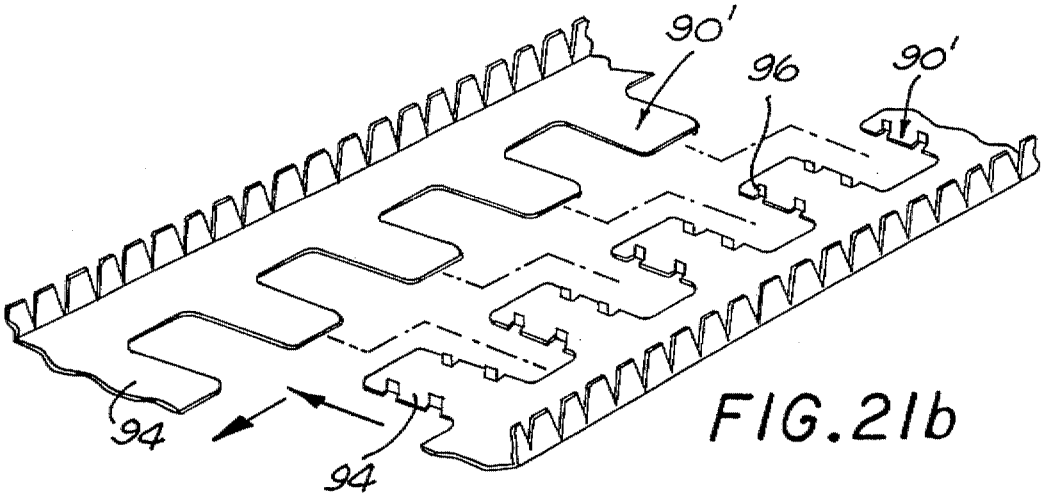
FIG. 21*b* is a view of the two piece arch member of FIG. 21*a* showing the two pieces separated.
Figure 21C:
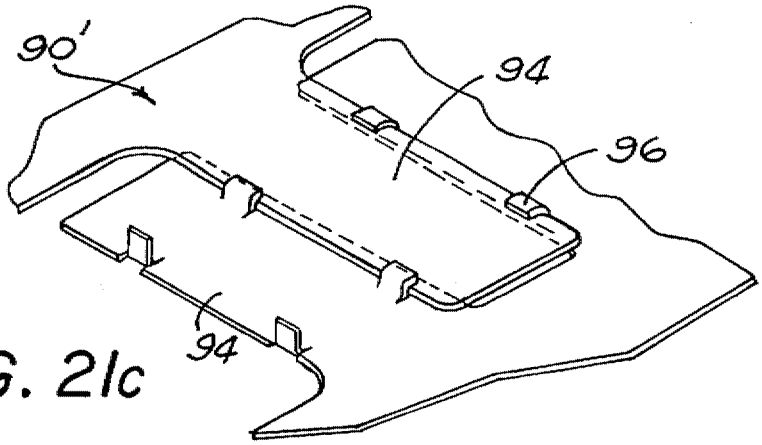
FIG. 21*c* is a view of a section of FIG. 21*a* showing the fingers interlocked.

FIGS. 21*a* and 21*b* show another adjustable arch member having two sawtooth L-shaped members 90'. Each member has a plurality of fingers 94. The left member has a plurality of tabs 96 that are bent onto the fingers of the right member, when the fingers of the right member are slid over the fingers of the left member as more clearly shown in FIG. 21*c*. The right member fingers are thus captured between the tabs and upper surface of the underlying left fingers holding the two pieces together. Because the two parts are slideable relative to each other, the width of the arch member may be adjusted as desired.

FIGS. 22 through 24 show an alternate embodiment of an arch member that has a pair of flanges 100 extending from the end of an elongate body section 20'. On the other end of the arch member are a pair of slots 102 of such dimension and location to allow the flanges 100 to be inserted therethrough. As shown in FIG. 24, the flanges 100 are inserted into the apertures 102, wherein the flanges are bent 180° to more securely attach the two ends of the arch member together. This allows the arch member to be bent with a smooth curvature over the joint into a circular or other similar shape, such that a circular window or such can be constructed. This embodiment also reduces waste, in that any excess material can be cut off and reattached to another arch member. Although two flanges 100 and apertures 102 are shown, any number of flanges and apertures can be used including one large flange.

Figure 25:
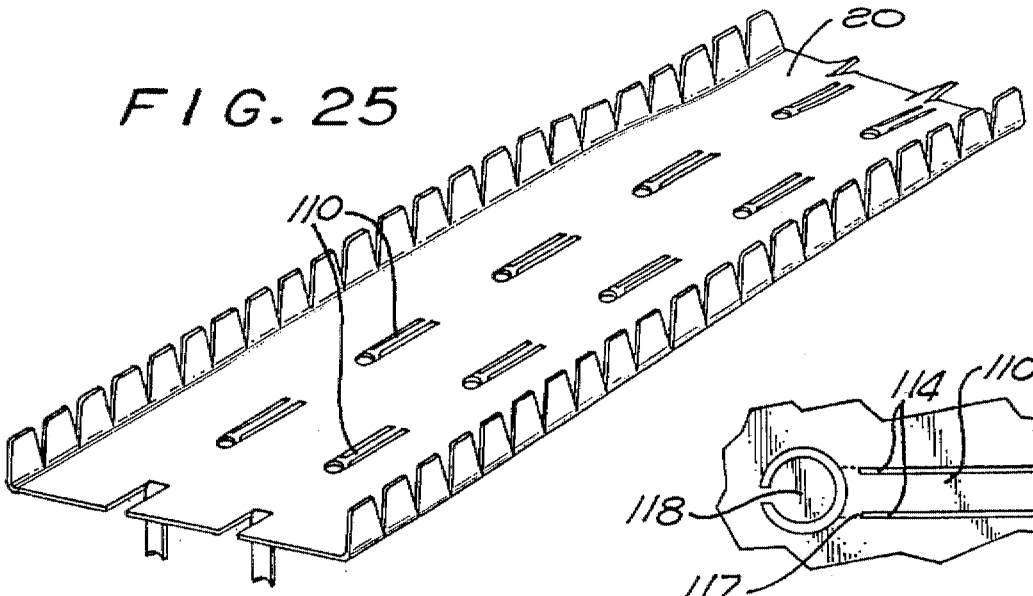
FIG. 25 is a perspective view of an elongated member with a plurality of tabs within the central section of the member.
Figure 25A:
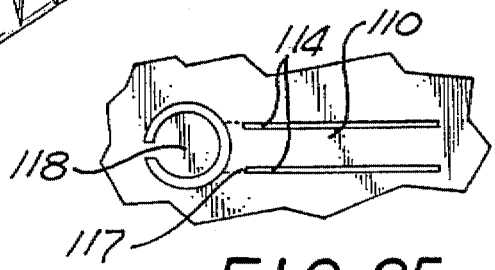
FIG. 25*a* is an enlarged view of the elongate member of FIG. 25 showing the configuration of a bendable tab.
Figure 26:
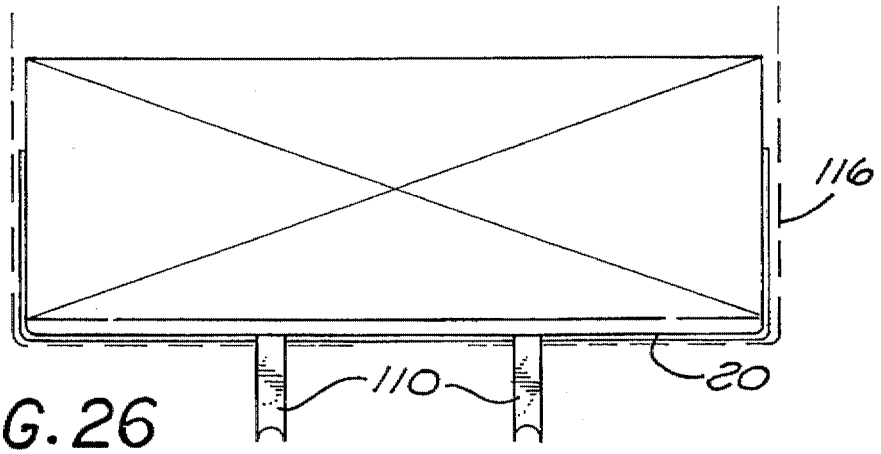
FIG. 26 is a side view of the elongated member of FIG. 25 with siderails attached and the tabs bent down.
Figure 27:
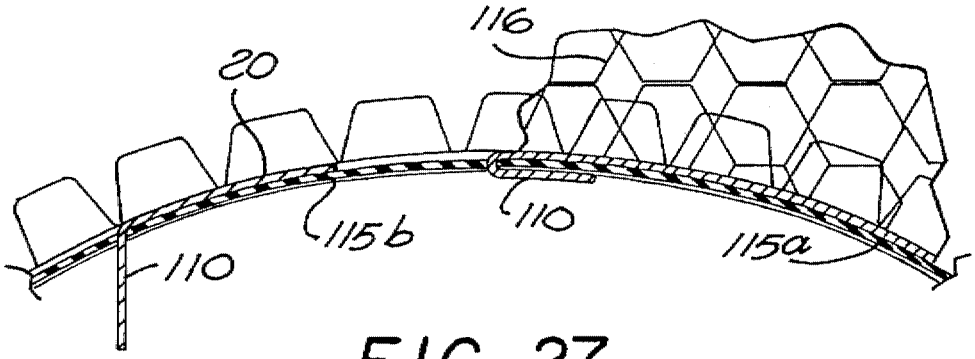
FIG. 27 is a side view of a portion of an elongated member having insulation and chicken wire attached, wherein the tabs are extended through and are bent around the chicken wire.

FIGS. 25–27 show another embodiment wherein the elongate body section 20 has a plurality of tabs 110 each formed by drilling or punching a hole 112 and then cutting a pair of parallel slits 114. The holes 112 being of such diameter to allow a nail to be inserted into the holes 112 to bend the tabs 110 in the direction shown in FIG. 26. This embodiment is typically used when constructing outer walls. As shown in FIG. 27, the arch can be assembled by first nailing the member 20 to the studs, attaching foam 115*a* to the inner surface of the arch member and an outer layer of paper 115*b* to the foam 115*a*. Then a wire mesh 116 is wrapped around the arch member. The tabs 110 are inserted through the mesh 116 and attached as shown in FIG. 27, being bent over at a length as required to accommodate the insulation 115*a*, paper 115*b* and mesh 116. Thus the arch member provides a means of attaching the wire mesh 116 in addition to creating a form for an archway. The tabs 110 preferably have bridges 117 near the holes 112, that break when the tabs 110 are forced outward. The bridges 117 allow the arch member to be bent without having the tabs 110 stick out unless specifically intended. Typically plaster is applied to one side of the elongate body section 20. To reduce the amount of plaster than can flow through the holes 112 and slump back, each tab 110 can have a cover portion 118 located within the hole 112 that can be easily pushed in when the tab 110 is to be bent.

FIGS. 28*a* and 28*b* show a method of attaching the arch member and a tool 120 for facilitating the same. The tool 120 comprises a handle 122 having a vice grip 124 that grasp a shaft 126 attached to a cylindrical head 128. The handle 124 is hollow to allow the shaft 126 to slide in and out, the vice grip 124 being of a conventional type that rotates to grasp or release the shaft 126. The handle 122, vice grip 124 and shaft 126 thus to allow the length of the tool 120 to be varied as desired. To mount the arch member, a centering board 130 is nailed to the king studs 28. The tool 120 is attached to the centering board 130 by driving a nail through a hole 132 in the handle into the board 130. The arch member is placed within the opening frame, wherein the head of the tool 120 is adjusted to press against the arch member allowing the tabs 22 to be nailed to the frame. It is preferable to start at the top of the arch and move the tool 120 in a clockwise and a counterclockwise manner, attaching the tabs 22 as the tool 120 is pressed against the arch member along the circumference of the arch. As can be seen the centering board 130 and tool 120 can be located anywhere within the opening such that the tool can install an arch member having a circular, elliptical, equilateral shape or the like or any radial segment therein. The tool 120 allows easy attachment of the arch member by a single user, wherein the tool 120 holds the arch in place while the user tacks on the tabs 22. Although an arch member with two rows of tabs has been described and shown, it is to be understood that the elongate member can be used with only one row of tabs. Having one row of tabs is particularly useful when the form is used to define the outline of a window, wherein the tabs are nailed to studs on the inside of the structure.

The arch member can also be installed by installing the forms shown in FIGS. 29–33, wherein the forms 140 are constructed from an elongated member 20 bent to and supported in the desired shape, such that the form 140 can support the arch member while the tabs of the member are nailed to the frame of the opening.

Figure 29:
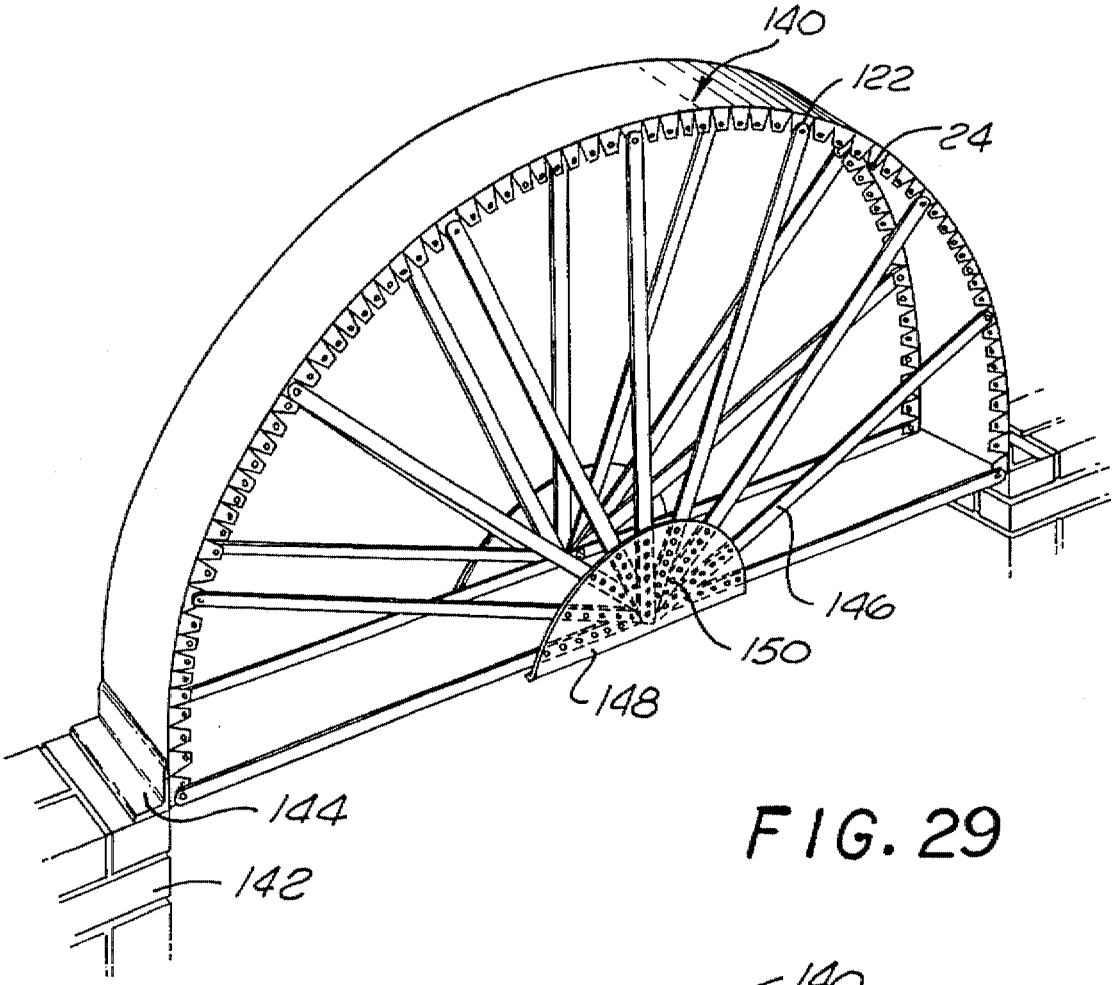
FIG. 29 is a form typically attached to an external wall to construct an archway in the same.
Figure 30:
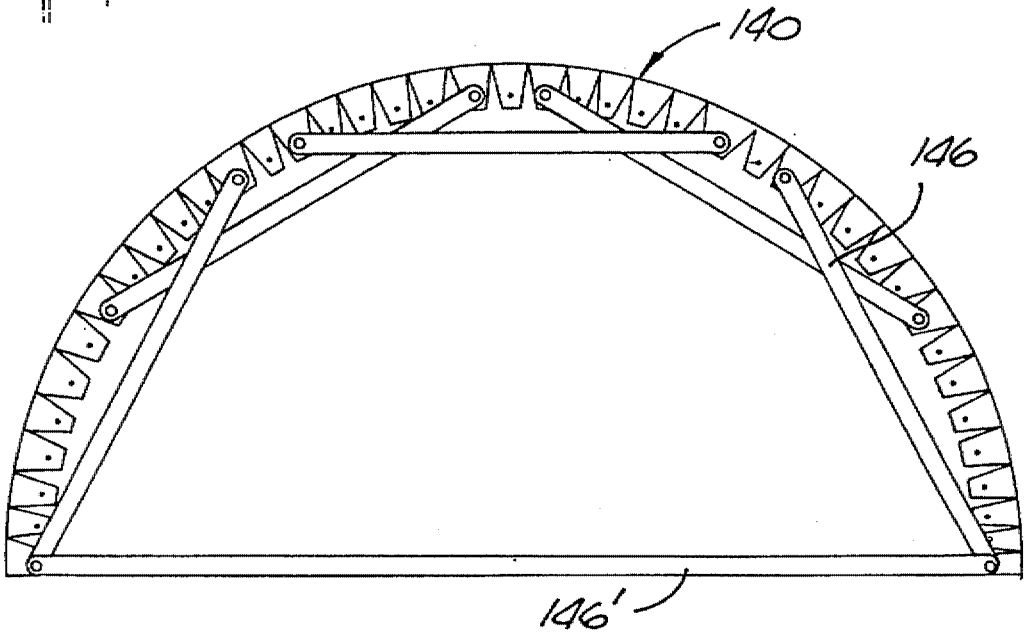
FIG. 30 is an alternate embodiment of the form of FIG. 29.

The forms 140 can also be used to construct archways for external walls. As shown in FIG. 29 the elongate member 20 can be attached to brick walls 142 by a pair of brackets 144. The elongated member 20 acts as a support for masonry material to be built on top of the form 140. In the alternative, the form 140 can support and define a concrete archway. When a rough outline of the archway is complete, the form 140 is removed and the archway is completed. To provide structural support for the elongated member 20, a plurality of spokes 146 can be attached to a hub 148 and extend out to and connect with the tabs 22 of the elongate member 20. As shown in FIG. 31, the spokes 146 can be constructed from metal angle of C-channel stock and have a plurality of holes 150 that align with holes in the hub 148, such that the spokes 146 can be attached to the hub 148. The plurality of holes 150 in the spokes 146 and hub 148 provide a means of adjusting the shape and radius of the form 140. The hub 148 and or spokes 146 could have a slot or other configuration to allow the adjustment of the spokes 148. The opposite end of the spokes 146 can be attached to the tabs 22, with a rivet or other means that extends into the tab holes 24. FIGS. 30 and 32 show alternate embodiments having a center spoke 146' across the diameter of the form 140. FIG. 30 shows a plurality of spokes 146 attached at each end to a tab 22 in an overlapping fashion. FIG. 32 shows a plurality of triangularly arranged spokes 146" attached as shown. FIG. 33 shows a form without spokes that has a modified elongated member 20' with a plurality of long rectangular tabs 22', that provide radial stiffness along the length of the form 140. Like the arch members, the forms 140 can be constructed from any material and have flat elongated members as shown in FIGS. 1, 3, 6, 7, 10 and 13. The tabs 22' can then be bent 90° and the spokes 146 can be attached such that the elongated member has the desired shape. The flat elongated member and attachable spokes provide a form that can be easily shipped and assembled.

To further improve the packing efficiency of the arch member, the member can be assembled from individual pieces as shown in FIG. 34. Each tab 150 can be constructed with a C-shaped channel portion 152 that attaches to a flat central member 154. The arch member has a plurality of attachable tabs 150 along both sides of the flat central member 154. The tabs 150 may be constructed such that the top portion 156 of the tabs are spaced from the central member ends, to produce an arch member similar to the one shown in FIG. 8. The width of the C-channel 152 is smaller than the thickness of the central member so that the tabs 150 clip onto the central member 154. In addition, or in the alternative, the C channel 152 may have a protrusion 158 or protrusions that extend toward the central member 154 that presses against the member to more securely fasten the tab 150. The central member 154 may have a corresponding indentation to receive the protrusion 158. To create a more conjunctive surface to paint or plaster to, an angle section 160 may be added that is attached to the central member 154 and side member 38. The angle section 160 may be constructed to produce the bead-like or rounded edges of FIGS. 15 and 16 and should have a surface conducive to the application of paint or plaster.

FIG. 35 shows an alternate embodiment of a two-piece arch member that is preferably extruded from a flexible plastic. The central member 154' has a pair of flanges 170 on each edge constructed to produce an L-shaped channel 172, wherein each edge has a plurality of L-shaped flange channels 172. Each tab 156' has a mating L-shaped end portion 174 that slides or snaps into the L-shaped flange channel 172, to attach the tabs 156' to the central member 154'. The tabs 156' are attached to a side member 38 and may further include an angle section 160 as described above. The central members 154' may have two or more L-shaped flange channels 172 separated by notches 176 constructed to allow the end channel to be broken off, such that the width of the central member 154' may be varied. The arch member can be assembled to have tabs on just one side, wherein side wall is attached on only one side. This configuration is particularly useful in constructing external windows. FIG. 36 shows an alternate embodiment of FIG. 35 wherein the tab 156" has a block end 180 that fits within a similarly configured channel 182 on a central member 154". FIG. 37 further shows how the tabs 156" can be snapped into the central member 154".

Figure 38:
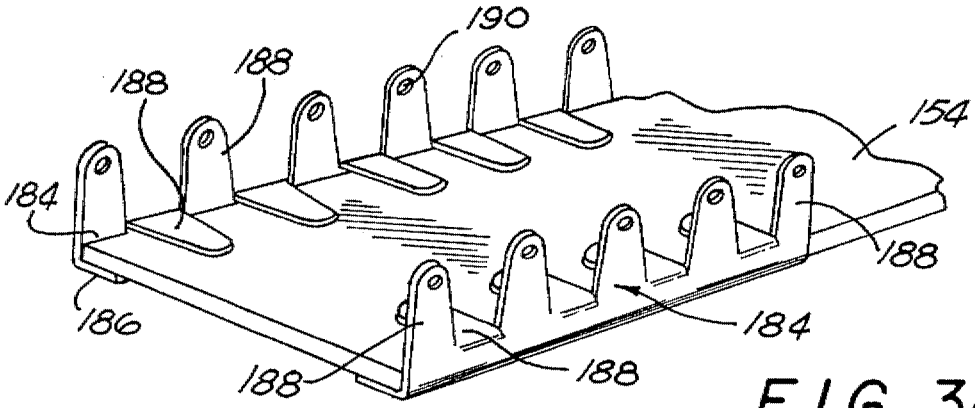
FIG. 38 is a perspective view of an alternate embodiment of an archway.
Figure 39:
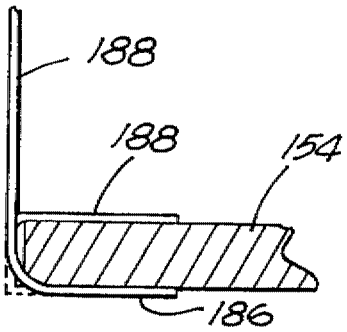
FIG. 39 is a sectional side view of the archway of FIG. 38.
Figure 40:
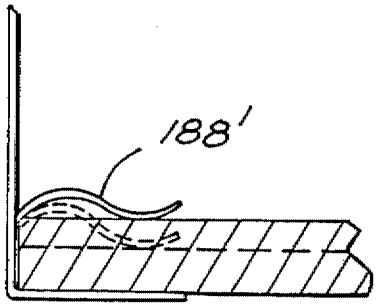
FIG. 40 is a view similar to FIG. 39 showing a tab of the archway constructed as a wavy spring.

FIG. 38 shows another embodiment of an archway that has tab strips 184 which can be attached to a flat central member 154. The flat member 154 can be constructed from any material, including but not limited to drywall, steel or masonite. The strips 184 have leg portions 186 which extend along one side of the flat member 154. The strips 184 also have a plurality of tabs 188 that, before any are bent, are typically perpendicular to the leg portions 186. The strips 184 are fastened to the flat member 154 by bending every other tab 188 as shown in FIG. 38. It being understood that every third or fourth tab could be bent to fasten the strips 184 to the member 154. As shown in FIG. 39, the flat member 154 is captured between the bent tabs 188 and the leg portion 186. The bent tabs 188' may be shaped as a wavy spring as shown in FIG. 40. The spring tabs 188' are constructed to insure engagement with flat members of various thicknesses.

Figure 41:
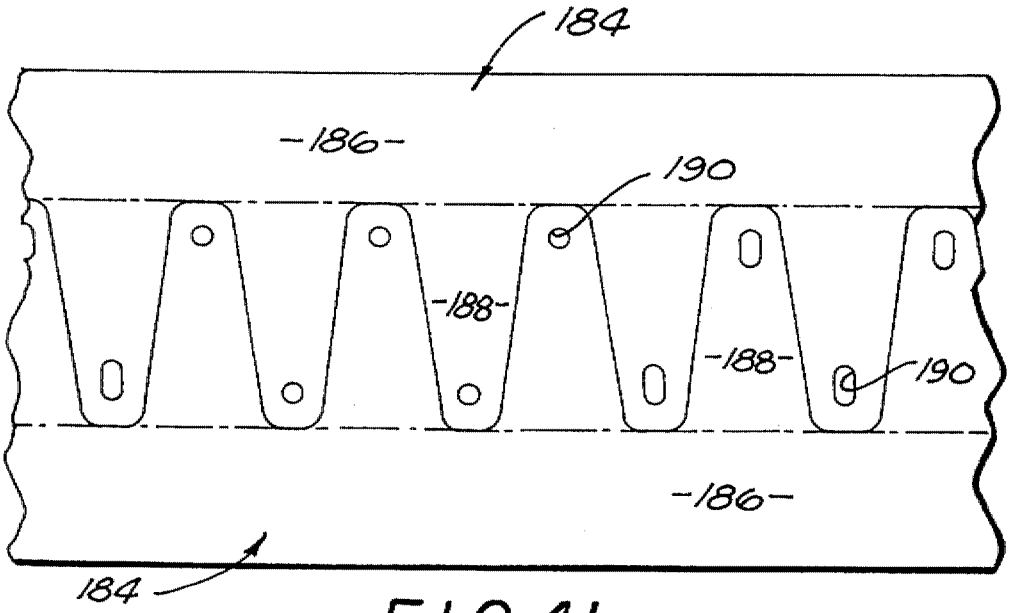
FIG. 41 is a top view showing two strips punched out of a single sheet of material.
Figure 43:
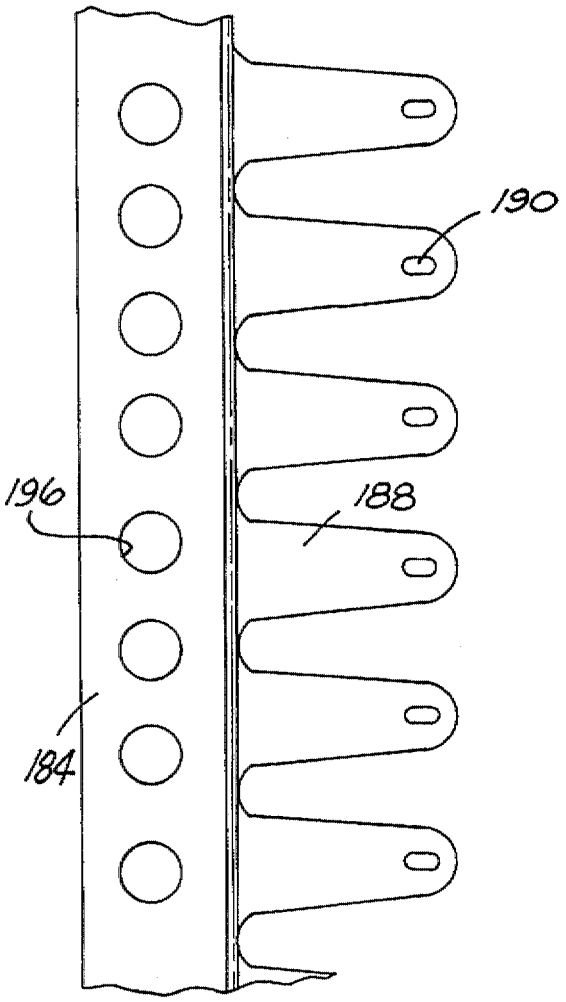
FIG. 43 is a top view of an alternate embodiment of the strip of the archway.
Figure 42:
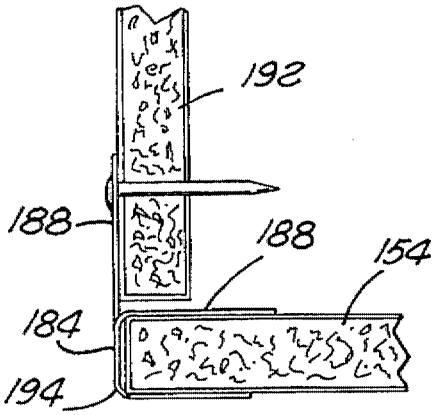
FIG. 42 is a section view of the archway of FIG. 39 attached to a stud.

The tabs 188 are preferable symmetrical so that two strips and accompanying holes 190, may be punched or cut from a single sheet of material as shown in FIG. 41. The tabs 188 each have an aperture 190 to allow nails to be driven through, to attach the strips 184 to a stud 192 as shown in FIG. 42. The strips 184 may have rounded corners 194, typically with a radius of 1/16" or 3/32". As shown in FIG. 43, the strips 184 preferably have holes 196 in the leg portion 186. When the archway is plastered, the holes 196 provide an area for the wet plaster to adhere to, thereby improving the quality and reducing the construction time of the finished archway.

Figure 44:
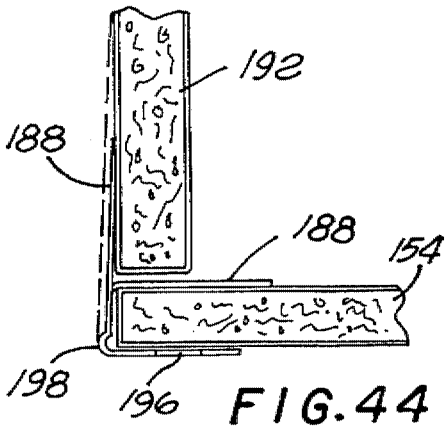
FIG. 44 is a view similar to FIG. 42 showing an alternate embodiment of a strip with a protruding corner.
Figure 45:
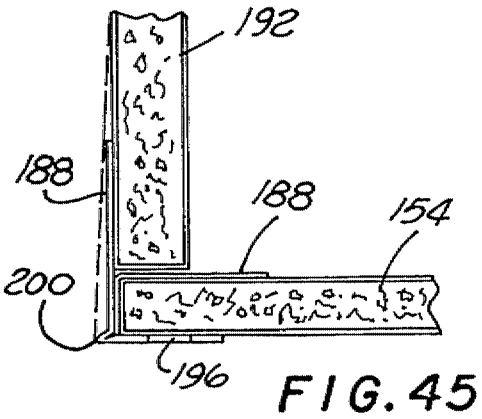
FIG. 45 is a view similar to FIG. 42 showing an alternate embodiment of a strip with a protruding corner.

FIGS. 44 and 45 show alternate embodiments of the strips 184, wherein the corners extend outward and have a radial 198 or an angular 200 shape, respectively. The corners 198 and 200 provide an area for the wet plaster to reside in. The holes 198 and extended corners greatly improve the application of plaster in the construction of the archway.

Figure 46:
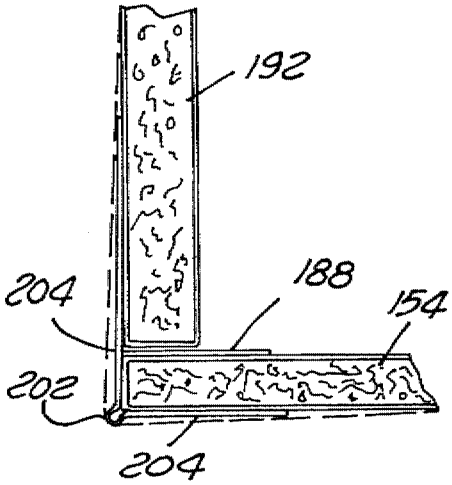
FIG. 46 is a view similar to FIG. 42 showing another alternate embodiment of a strip with a protruding corner.
Figure 47:
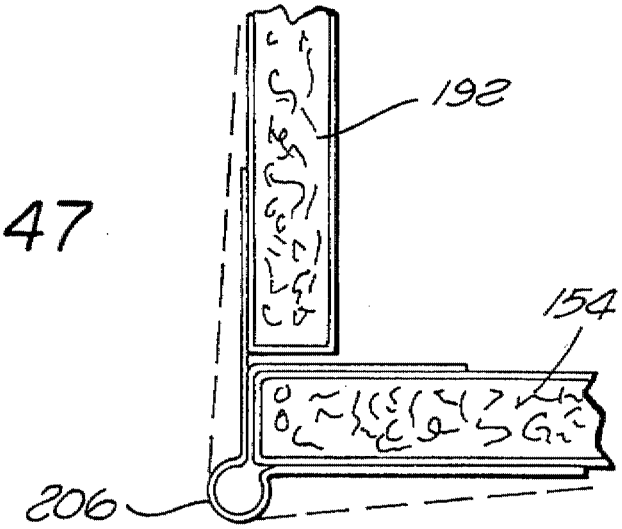
FIG. 47 is a view similar to FIG. 46 showing a strip with a radially shaped protruding corner.

FIG. 46 shows another embodiment of the strips 184, wherein there is a corner 202 that protrudes along the horizontal and vertical axis of the member. The corner 202 creates a pair of indented portions 204 that provide an area for the plaster to reside in. Such an embodiment is particularly useful if the strip 184 is used with rockwall. FIG. 47 shows a modified version of the strip 184, wherein the corner 206 has a predefined radius.

Figure 48:
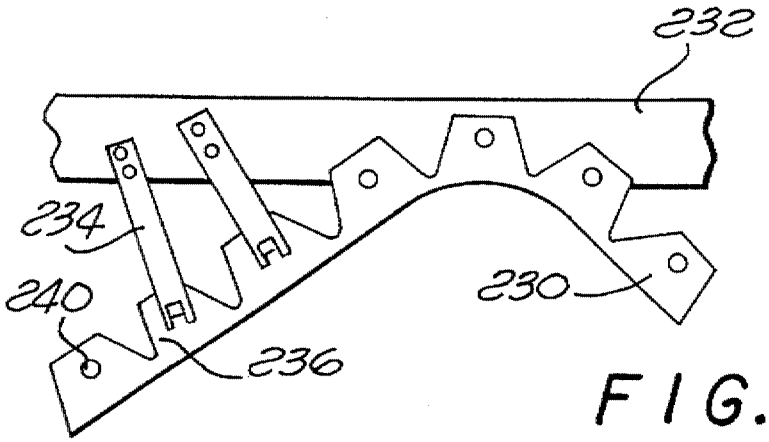
FIG. 48 is a side view showing an elongated member attached to a wood frame, with extenda-tabs attached to both the frame and the member.

FIG. 48 shows a preferred embodiment of an elongated member 230 attached to a wood frame 232. Wood frames 232 are typically constructed in a rectangular shape, so that when the member 230 is attached in a radial shape, there are portions of the member that are unsupported by the frame 232, resulting in straight portions in the resulting arch.

Figure 49:
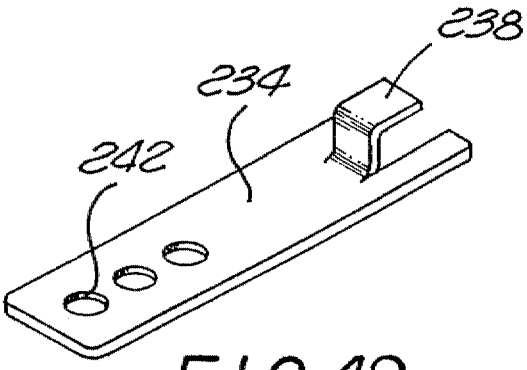
FIG. 49 is a perspective view of an extenda-tab.
Figure 50:
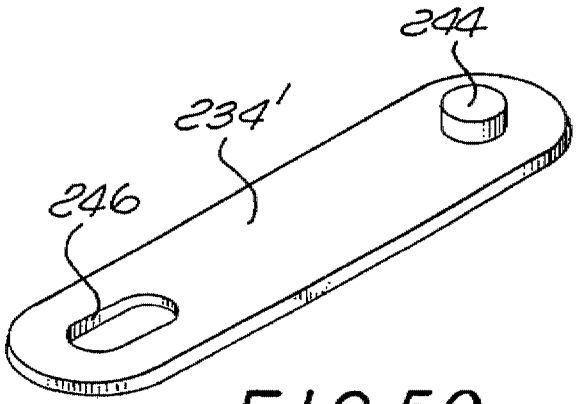
FIG. 50 is a perspective view of an alternate embodiment of an extenda-tab.

To provide additional support to the member 230, extenda-tabs 234 can be attached to the tabs 230 of the frame 232. FIG. 49 shows one embodiment of the extenda-tab 234, that has a spring tab 238 that can be inserted into holes 240 of the frame tabs 236. After the member 230 has been nailed to the wood frame 232, the spring tabs 238 are pressed onto the holes 240. The user then adjusts the member 230 to obtain the desired radius and nails the extenda-tabs 234 into the frame 232. The extenda-tab 234 may have a number of holes 242 to allow easy attachment of the tab 234, while providing a range of attachment points on the frame 232. FIG. 50 shows an alternate embodiment, wherein the extenda-tab 234' has a stud 244 that can be inserted into the holes 240 of the member 230. The stud 244 typically has a diameter slightly larger than the diameter of the hole 240, so that the extenda-tab 234' remains attached to the member 230 after stud 244 is pressed into the tab 236. The extenda-tab 234' may have a slot 246 to allow the tab 234' to be attached to the frame at different locations.

Thus, while the present invention has been disclosed and described herein with respect to certain preferred embodiments thereof, it will be understood by those skilled in the art that various changes In form and detail may be made therein without departing from the spirit and scope of the invention.

What is claimed is:

1. A method for constructing an archway in a frame that defines an opening with a width, comprising the steps of:

a) providing a flat flexible member having a solid center sheet section defining longitudinal edges and with a longitudinal axis, a first surface and a second surface, said flat flexible member further having tabs extending from said longitudinal edges of said second surface of said center sheet section, said flexible member being constructed to be flexible enough to be manually bent;

b) manually bending said flat flexible member along the longitudinal axis of said solid center sheet section into a radial arch shape without yielding said flexible member; and, c) attaching said tabs to the frame such that said flexible member forms an archway.

2. The method as recited in claim 1, further comprising the step (d) of applying a mud plaster directly to said first surface of said flexible member.

3. The method as recited in claim 2, further comprising the step of applying a bonding agent to said first surface of said flexible member before said flexible member is bent.

4. A method for constructing an archway in a frame that defines an opening with a width, comprising the steps of:

a) providing a flat flexible member that has a solid center sheet section defining longitudinal edges and a longitudinal axis, a first surface and a second surface, said flat flexible member further having tabs extending from said longitudinal edges of said second surface of said center sheet section, said flexible member being constructed from steel with a thickness between 22–26 gauge so that said flexible member is flexible enough to be manually bent;

b) manually bending said flat flexible member along the longitudinal axis of said solid center sheet section into a radial arch shade without yielding said flexible member;

c) attaching said tabs to the frame such that said solid center section extends across the width of the opening.

5. The method as recited in claim 4, further comprising the step of applying a bonding agent to said first surface of said flexible member before said tab are attached to the frame.

6. The method as recited in claim 5, further comprising the step of applying a mud plaster directly to said first surface of said flexible member after said step (c).

* * * * *